US007878244B2

(12) United States Patent
Nold, III et al.

(10) Patent No.: US 7,878,244 B2
(45) Date of Patent: Feb. 1, 2011

(54) APPARATUS AND METHODS TO PERFORM FOCUSED SAMPLING OF RESERVOIR FLUID

(75) Inventors: Ray Nold, III, Beasley, TX (US); Alexander Zazovsky, Houston, TX (US); Ricardo Vasques, Sugar Land, TX (US); Steven G. Villareal, Houston, TX (US); Reinhart Ciglenec, Katy, TX (US); Albert Hoefel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 20 days.

(21) Appl. No.: 11/829,460

(22) Filed: Jul. 27, 2007

(65) Prior Publication Data

US 2008/0245569 A1 Oct. 9, 2008

Related U.S. Application Data

(60) Provisional application No. 60/882,364, filed on Dec. 28, 2006.

(51) Int. Cl.
*E21B 49/08* (2006.01)

(52) U.S. Cl. ..... 166/264; 166/100; 175/59

(58) Field of Classification Search ..... 166/100, 166/105, 107, 264; 73/152.24; 417/56, 62, 417/205, 212, 213, 268, 393, 397, 403, 404, 417/414, 418, 437, 446, 531, 534; 175/58, 175/59

See application file for complete search history.

(56) References Cited

U.S. PATENT DOCUMENTS 154,468 A * 8/1874 Flanders ..... 417/285
479,260 A * 7/1892 Farrell ..... 417/28
1,001,295 A * 8/1911 Moorhead ..... 417/63
2,717,612 A * 9/1955 Afileck ..... 137/102
3,459,363 A * 8/1969 Miller ..... 417/446
3,659,967 A * 5/1972 McArthur et al. ..... 417/397
3,791,770 A * 2/1974 Farkos ..... 417/418
4,087,209 A * 5/1978 Mahig et al. ..... 417/268
4,178,240 A * 12/1979 Pinkerton ..... 210/646
4,272,226 A * 6/1981 Osborne ..... 417/418
4,527,959 A * 7/1985 Whiteman ..... 417/342
4,893,505 A * 1/1990 Marsden et al. ..... 73/152.24
5,007,812 A * 4/1991 Hartt ..... 417/534

(Continued)

FOREIGN PATENT DOCUMENTS

GB 2390105 12/2003

(Continued)

OTHER PUBLICATIONS

Merriam-Webster.com, Meter definition, accessed Nov. 4, 2009.*

*Primary Examiner*—Shane Bomar
*Assistant Examiner*—Blake Michener
(74) *Attorney, Agent, or Firm*—Dave R. Hofman

(57) ABSTRACT

Apparatus and methods to perform focused sampling of reservoir fluid are described. An example method couples a sampling probe to a subterranean formation and, while the sampling probe is coupled to the subterranean formation, varies a pumping ratio of at least two displacement units to reduce a contamination level of a formation flu id extracted via the sampling probe from the subterranean formation.

20 Claims, 11 Drawing Sheets

U.S. PATENT DOCUMENTS

| | | | | |
|---|---|---|---|---|
| 5,303,775 | A * | 4/1994 | Michaels et al. | 166/264 |
| 5,380,159 | A * | 1/1995 | Olsen et al. | 417/53 |
| 6,206,044 | B1 * | 3/2001 | Gluf, Jr. | 137/625.65 |
| 6,301,959 | B1 | 10/2001 | Hrametz et al. | |
| 6,497,556 | B2 * | 12/2002 | Zupanick et al. | 417/85 |
| 6,668,924 | B2 * | 12/2003 | Bolze et al. | 166/264 |
| 6,964,301 | B2 * | 11/2005 | Hill et al. | 166/264 |
| 7,124,819 | B2 * | 10/2006 | Ciglenec et al. | 166/264 |
| 7,178,591 | B2 * | 2/2007 | Del Campo et al. | 166/264 |
| 2003/0121703 | A1 * | 7/2003 | Bloom et al. | 175/99 |
| 2005/0111997 | A1 * | 5/2005 | Smith et al. | 417/364 |
| 2006/0042793 | A1 | 3/2006 | Del Campo et al. | |

FOREIGN PATENT DOCUMENTS

| | | |
|---|---|---|
| GB | 2404403 | 2/2005 |
| GB | 2408760 | 6/2005 |
| GB | 2418938 | 4/2006 |
| GB | 2422862 | 8/2006 |
| GB | 2425794 | 11/2006 |
| WO | WO9411611 | 5/1994 |
| WO | WO2004044380 | 5/2004 |

* cited by examiner

| | $V_1C$ | $V_2C$ | $V_3C$ | $V_4C$ | EFFECTIVE DISPLACEMENT |
|---|---|---|---|---|---|
| MODE 1 | 1 | 2 | 1 | 2 | L+S |
| MODE 2 | 1 | 2 | 2 | 1 | L-S |
| MODE 3 | 2 | 1 | 2 | 1 | L+S |
| MODE 4 | 2 | 1 | 1 | 2 | L-S |

APPARATUS AND METHODS TO PERFORM FOCUSED SAMPLING OF RESERVOIR FLUID

RELATED APPLICATION

This patent claims the benefit of the filing date of U.S. Provisional Patent Application No. 60/882,364 filed on Dec. 28, 2006.

FIELD OF THE DISCLOSURE

The present disclosure relates generally to reservoir evaluation and, more particularly, to apparatus and methods to perform focused sampling of reservoir fluid.

BACKGROUND

Drilling, completion, and production of reservoir wells involve monitoring of various subsurface formation parameters. For example, parameters such as reservoir pressure and permeability of the reservoir rock formation are often measured to evaluate a subsurface formation. Fluid may be drawn from the formation and captured to measure and analyze various fluid properties of a fluid sample. Monitoring of such subsurface formation parameters can be used, for example, to determine formation pressure changes along the well trajectory or to predict the production capacity and lifetime of a subsurface formation.

Some known downhole measurement systems may obtain these parameters through wireline logging via a formation tester or sampling tool. Alternatively, a formation tester or sampling tool may be coupled to a drill string in-line with a drill bit (e.g., as part of a bottom hole assembly) and a directional drilling subassembly. Such formation testing or sampling tools may be implemented using fluid sampling probes, each of which has a one or more nozzles, inlets, or openings into which formation fluid may be drawn. A variety of types of sampling tools or probes are currently used to extract formation fluid. For example, some sampling tools use an extendable probe, which is sometimes generally referred to as a packer, having a single nozzle or inlet to draw formation fluid. The probe (e.g., the nozzle or inlet), is typically surrounded by a circular or ring-shaped rubber interface or packer that is extended toward and forced against a borehole wall to sealingly engage the nozzle or inlet with a subterranean formation. In some cases, the seal provided by a packer may be implemented using an inflatable packer device such as, for example that described in U.S. Pat. No. 6,301,959. Some sampling probes or packers provide multiple inlets (e.g., two inlets) where at least one inlet is a sample inlet and at least one other inlet is a guard inlet. However, in the case of a multi-inlet configuration, multiple packers may be used such that at least one packer includes a sample inlet and another separate packer or packers include the guard inlet or inlets.

In operation, a sampling probe or packer may be extended via hydraulics from the downhole tool to drive its nozzle or inlet against the borehole wall adjacent a portion of the formation to be evaluated. A pumpout assembly is then activated to draw fluid from the formation into the probe and to convey the formation fluid to a downhole testing device and/or a sample collection vessel that can be retrieved to the surface to enable laboratory analysis of the sample fluid contained therein. Additionally, as noted above, the sampling probe inlet is typically surrounded by a packer that facilitates the sealing of the sampling probe inlet against the borehole wall and, thus, facilitates the application of a pressure to the formation to efficiently draw fluid from the formation.

When drawing fluid from a formation, a certain amount of filtrate can also be drawn into the probe along with the formation fluid, thereby contaminating the sample fluid. The degree of contamination (e.g., the percent contamination) in the sample fluid is initially relatively large, but typically decreases over time as the sampling probe continues to draw formation fluid from the formation. Thus, fluid extracted from the formation by the sampling probe is usually discarded until, at some time during the sampling process, the level of contamination is sufficiently low to permit capture of a sample having an acceptable purity for testing or evaluation purposes.

With single inlet sampling probes (i.e., a sampling probe providing only a sample inlet and no guard inlet), a relatively large amount of fluid may have to be drawn from the formation before an acceptable purity or contamination level is achieved. However, to draw such a large amount of fluid may require a significant amount of time, which can be costly, particularly if the job is delayed by the sampling process. Additionally, while the level of contamination can be reduced significantly by first drawing a large amount of fluid from the formation, the minimum level or degree of contamination achievable with a single inlet probe may remain high enough to affect the accuracy of the test results.

While single inlet sampling probes have proven to be relatively effective, dual inlet or guard probes can provide improved, focused sampling of formation fluids. Such dual inlet or guard probes typically include concentric nozzles or inlets, where a central nozzle or inlet is configured to act as the sampling inlet and an outer nozzle or inlet is configured to act as a guard inlet. More specifically, the guard inlet, which forms a perimeter or ring around the central or sampling inlet, is configured to draw substantially all of the filtrate away from the central part of the probe and, thus, the central inlet, thereby enabling the central or sampling inlet to draw in formation fluid that is relatively free of contamination (e.g., filtrate). Dual inlet or guard probes also utilize two packers to seal the probe against the formation to be evaluated. An outer packer surrounds the guard nozzle or inlet and an inner packer surrounds the central sample nozzle or inlet in the area between an outer wall of the sample inlet and an inner wall of the guard inlet.

In contrast to single inlet probes, dual inlet of guard probes can significantly reduce the time required to achieve a sufficiently low level of sample contamination (i.e., a reduced sample cleanup time), which can significantly decrease costs associated with evaluation of a formation (e.g., reduced station times). Additionally, dual inlet or guard probes can also provide significantly improved sample purity (i.e., a lower level of contamination) than possible with conventional single inlet probes. Such an increased level of sample purity can provide more accurate information for optimizing completion and production decisions.

Although dual inlet or guard probes have enabled significantly reduced sample cleanup times and improved sample purity levels, such dual inlet probes can introduce certain operational complexities or difficulties. In particular, each nozzle or inlet typically has its own independently controlled pumpout and flowlines (e.g., guard and sample flowlines), which makes it difficult to control precisely the relative pumping rates (i.e., the pumping distribution) of the sample and guard nozzles or inlets and flowlines. An inability to control precisely the relative pumping rates of the guard and sample inlets and flowlines can lead to higher levels of contamination in the sample fluid, compromising of the inner packer seal or breakage of the inner packer, longer sample cleanup times, etc. Further, the use of an independent pumpout for each inlet and flowline results in less available power for each pumpout and can also result in a lower overall power efficiency.

With some known dual inlet or guard probe systems, the differential pressure developed across the pumpouts is relatively fixed based primarily on the configuration of the displacement units within the pumpouts and the mobility of the fluid to be sampled. Thus, for a particular fluid mobility, a particular displacement unit may be selected to provide a desired pumping rate for each of the guard and sample inlets and flowlines as well as a relative pumping rate or pumping distribution between the guard and sample systems. However, fluid mobility may not be known precisely prior to sampling and, thus, a selected displacement unit may develop a differential pressure that results in poor fluid sampling (e.g., flow between the sample and guard inlets and, thus, increased sample contamination) and/or compromise of or damage to the inner packer. Additionally, further adjustments of the pumping rate and differential pressure developed by the pumpout(s) typically requires replacement of the displacement unit(s) at the surface, which is time consuming and costly.

SUMMARY

In accordance with one exemplary embodiment, an apparatus for use with a downhole tool is disclosed. The apparatus includes a displacement device and a valve. The displacement device has a first plurality of chambers that are fluidly coupled to a flowline associated with the downhole tool, and the valve is fluidly coupled between the first plurality of chambers to vary a fluid pumping rate through the flowline.

In accordance with another exemplary embodiment, an apparatus for use with a downhole tool is disclosed. The tool includes a first displacement unit to vary a first fluid characteristic associated with a first flowline, a second displacement unit to vary a second fluid characteristic associated with a second flowline, wherein the first and second displacement units are operatively coupled to operate synchronously, and a motor operatively coupled to the first and second displacement units.

In accordance with another exemplary embodiment, a pump for use with a downhole tool is disclosed. The pump includes a plurality of chambers, a plurality of pistons and at least one valve. Bach of the plurality of pistons corresponds to at least one of the chambers, and are operatively coupled to move synchronously. The at least one valve is fluidly coupled to at least one of the chambers to selectively change a flowrate provided by the pump.

In accordance with another exemplary embodiment, a method including: coupling a sampling probe to a subterranean formation, and varying a pumping ratio of at least two displacement units that are mechanically coupled to reduce a contamination level of a formation fluid extracted via the sampling probe from the subterranean formation, while the sampling probe is coupled to the subterranean formation is disclosed.

In accordance with another exemplary embodiment, an apparatus for use in a borehole is disclosed. The apparatus for use in a borehole includes a first displacement unit fluidly coupled to a first flowline, a second displacement unit fluidly coupled to a second flowline, and a motor operatively coupled to the displacement units to cause the displacement units to reciprocate synchronously.

In accordance with another exemplary embodiment, a method of controlling flowrate in a downhole tool is disclosed. The method includes lowering the downhole tool into a wellbore, fluidly coupling a first flowline associated with a first displacement unit to a subterranean formation in the wellbore, fluidly coupling a second flowline associated with a second displacement unit to the subterranean formation and synchronously reciprocating the first and second displacement units with a motor to extract fluid from the subterranean formation.

DETAILED DESCRIPTION

The example pumpout configurations described in greater detail below may be used with dual or guard probe sampling tools to provide improved, focused sampling of formation fluids. More specifically, the example pumpout configurations may be used to mechanically synchronize the displacement units associated with the guard and sample flowlines. However, it should be understood that while the example pumpout configurations described herein are discussed in connection with dual or guard probe sampling tools, the example pumpout configurations are more generally applicable and, thus, may be used with, for example, one or more single inlet probes if desired.

In contrast to conventional pumpout configurations used with dual or guard sampling probes, the example pumpout configurations described herein include controls to vary individually the differential pressure across each of the displacement units and, thus, the pumping rate distribution between or pumping ratio of the sample and guard flowlines. Such variations in differential pressure and pumping rate distribution can be automatically controlled to provide more rapid, focused formation fluid sampling while the tool remains in a downhole position. Thus, in contrast to some known systems, the example focused formation fluid sampling systems described herein eliminate the need to vary the pumping mode and/or the power provided to the hydraulic system, and/or removal and replacement of one or both displacement units (i.e., at the surface) to achieve a desired pumping rate distribution, for example. Further, the example focused formation fluid sampling systems described herein can be controlled in an adaptive manner to automatically control the differential pressure across the displacement units and the pumping rate of the guard and sample flowlines in response to variations in the formation characteristics and/or the formation fluid characteristics (e.g., fluid mobility), thereby enabling more rapid and accurate sampling, eliminating or minimizing the risk of inner packer failure, etc.

Figure 1:
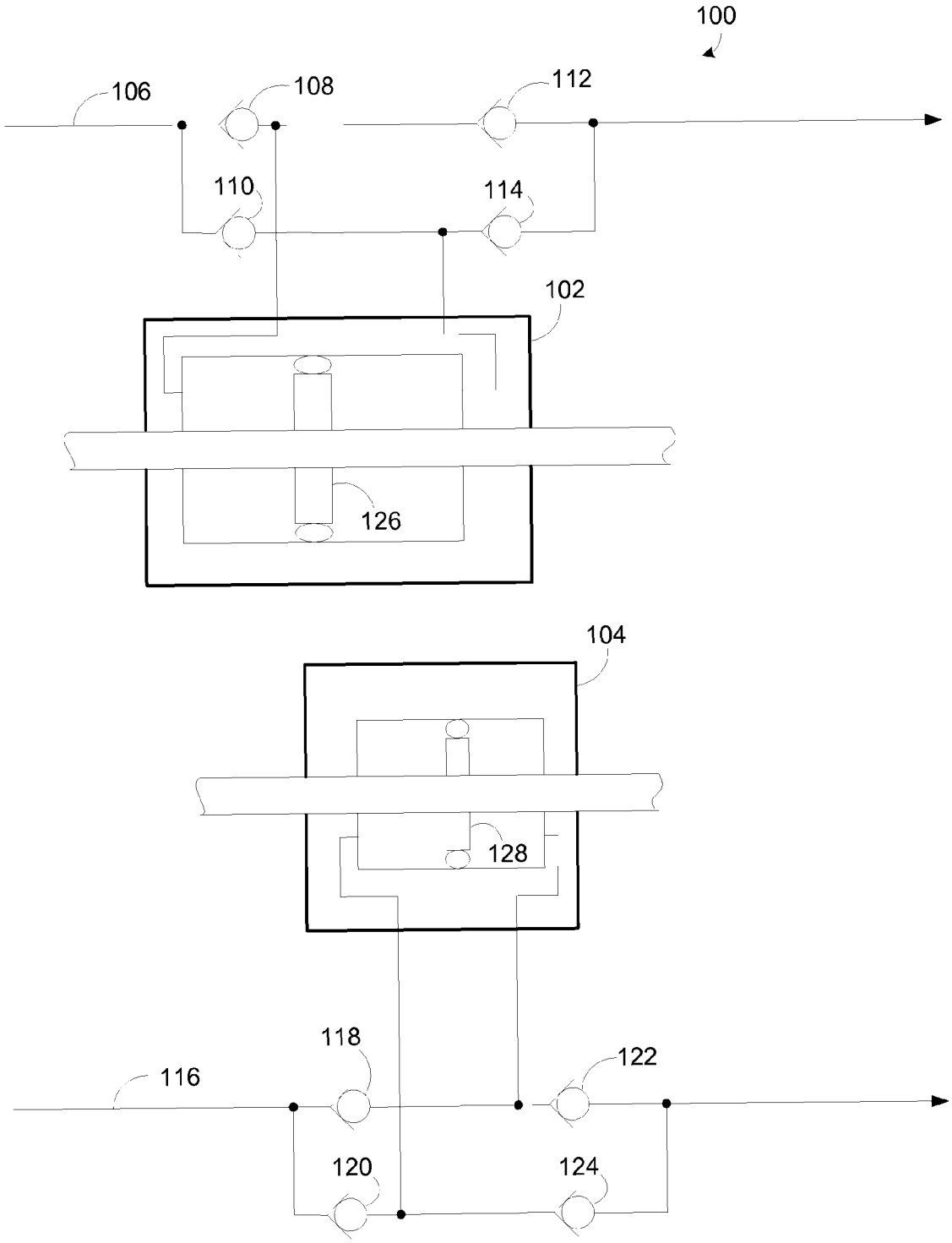
FIG. 1 (PRIOR ART)
FIG. 1 is a schematic diagram of a known pumpout configuration for a guard sampling probe assembly.

Before providing a detailed description of the example pumpout configurations noted above, a brief description of a known pumpout configuration is first provided in connection with FIG. 1. FIG. 1 is a schematic diagram of a known pumpout configuration or system 100 for use with a guard sampling probe assembly. In many oil extraction applications, positive displacement pumps are often used to extract fluid from a formation. A displacement pump is configured to displace a particular amount of fluid per stroke or per revolution. The fluid extracted from a formation is often thick and gritty making it impractical to use hydraulic pumps in a direct-pumping configuration. Instead, a hydraulic pump or a linear motor is typically connected to a displacement unit configured to generate a pumping force sufficient to extract the fluid from the formation. Traditional displacement units can generate a pumping pressure generally based on the volume of its piston chamber(s) and the characteristics of the attached pump or motor. In general, the known pumpout system 100 can be used with a dual or guard sampling probe to provide focused sampling of formation fluids. As depicted in FIG. 1, the known system 100 includes displacement units 102 and 104, each of which is driven independently in a conventional manner by a respective motor and/or hydraulic system (neither of which are shown). The displacement unit 102 is fluidly coupled to a guard flowline 106 via cheek valves 108, 110, 112, and 114 to enable fluid to be drawn from a guard nozzle, inlet, or portion of a dual or guard sampling probe (not shown) and conveyed or pumped in the direction of the arrow to, for example, a borehole annulus. Similarly, the displacement unit 104 is fluidly coupled to a sample flowline 116 via check valves 118, 120, 122, and 124 to enable fluid to be drawn from a sample nozzle, inlet or portion of the dual or guard sampling probe and conveyed or pumped in the direction of the arrow to, for example, a sample collection vessel. Alternatively, the flow line 116 may be coupled to the back side of a sliding piston positioned in a sample collection vessel, as known in the art as a reverse low shock sampling technique.

Each of the displacement units 102 and 104 is selected to provide a desired differential pressure and/or pumping rate to extract sample fluid from a particular formation. For example, a formation yielding a relatively low mobility fluid may require the use of displacement units that are configured to provide relatively high differential pumping pressures. Thus, with the known system 100, several different displacement unit configurations providing different differential pressures are typically available. In this manner, appropriate displacement units can be selected and installed in a downhole tool to suit the needs of a particular formation, fluid, and/or sampling application.

Further, as depicted in FIG. 1, the displacement units 102 and 104 may be differently sized or configured to provide a desired pumping rate distribution or pumping ratio and/or pressure across an inner packer of the sampling probe. Typically, the displacement unit 102 used in connection with the guard flowline 106 is sized to provide a pumping rate that is two to four times the pumping rate that the displacement unit 104 provides to the sample flowline 116. While it is possible to select displacement units that generally suit the needs of a particular sampling application, such a selection may be complicated by the uncertainties associated with formation characteristics, formation fluid characteristics, changes that occur to the formation and/or the fluid being sampled therefrom, etc. As a result, an initial selection of displacement units may fail to perform as anticipated or desired. To improve sampling performance, the downhole tool can be removed from the borehole and one or both of the displacement units 102 and 104 can be replaced with differently configured units that may provide the desired sampling performance. However, such an empirical process of determining the best or substantially optimal displacement unit configurations may require several time consuming and expensive replacement and test cycles to ensure that a desired or acceptable sampling is performed.

The mechanical operational independence of the displacement units 102 and 104 used in the known system 100 also results in certain operational inefficiencies and/or difficulties. For example, because the pressures developed across each of the displacement units 102 and 104 can vary significantly about an average value throughout the strokes of respective pistons 126 and 128, pressure spikes developed by the displacement units 102 and 104 can induce significant transient perturbations of the local flow pattern near the inlets of the sampling probe, thereby adversely affecting the ability of the sampling probe to effectively separate formation fluid and filtrate. To alleviate the effects of such pressure variations, the known system 100 typically utilizes a relatively complex synchronization operation via which the pumping through the sample flowline 116 is interrupted when the piston 126 of the displacement unit 102 (i.e., for the guard flowline 106) is near the end of its stroke.

As noted above, the known system 100 utilizes a separate motor (e.g., electric and/or hydraulic) for each of the displacement units 102 and 104, which typically results in a lower overall power efficiency and reduces the power available to operate each of the displacement units 102 and 104. As a result, the known system 100 typically does not operate both of the displacement units 102 and 104 during a cleanup phase of the sampling process. For example, to perform the cleanup (i.e., a procedure by which the sampled fluid is drawn and discarded until a desired level of sample purity is achieved to enable the subsequent collection of a sample to be analyzed), only the displacement unit 102 may be operated and the system 100 may be configured in a commingle mode in which the displacement unit 102 pumps or draws formation fluid through both the guard and sample flowlines 106 and 116. When the formation fluid being drawn by the displacement unit 102 reaches the desired level of purity (i.e., reaches a sufficiently, low level of contamination), the system 100 switches to a split mode of operation in which both of the displacement units 102 and 104 operate independently and in which fluid is drawn from the guard portion of the sampling probe by the displacement unit 102 and from the sample portion of the sampling probe by the displacement unit 104.

Another difficulty associated with the known system 100 depicted in FIG. 1 relates to the minimum pumping rate and differential pressure achievable with the displacement unit 104 that is used to pump fluid from the sample portion of the dual probe. In particular, although several displacement units may be available to provide a desired differential pressure and pumping rate, in some applications such as those involving relatively low mobility formation fluids, it may not be possible to reduce the differential pressure below a level that is potentially destructive to the inner packer of the sampling probe.

Figure 2A:
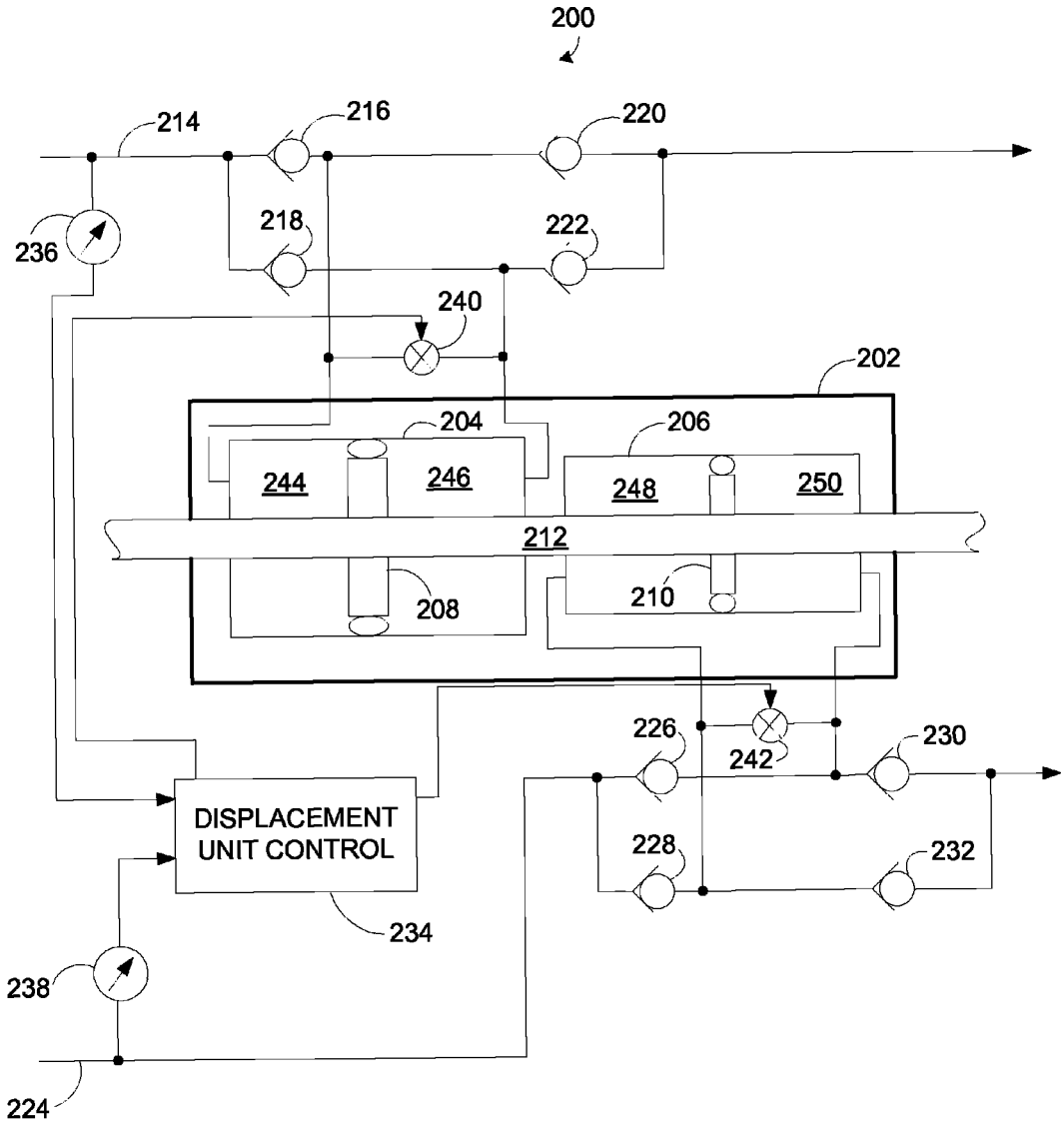
FIG. 2A is a schematic diagram of an example pumpout configuration having a dual displacement unit assembly where the differential pressure across each displacement unit can be controlled independently.

FIG. 2A is a schematic diagram of an example pumpout configuration 200 having a dual displacement unit assembly 202 where the differential pressure across each displacement unit can be controlled independently. Also, in contrast to the known system 100 of FIG. 1, the displacement unit assembly 202 includes displacement units 204 and 206 that are mechanically linked or coupled to operate in unison or in a synchronized manner. The example dual displacement unit assembly 202 may be implemented as a single body or housing having four chambers (i.e., two chambers for each of the displacement units 204 and 206) and respective pistons 208 and 210 attached to a common shaft 212 and motor (not shown). Alternatively, the dual displacement unit assembly 202 may be implemented as multiple bodies or housings (e.g., two or more housings), each of which contains one or portions of the displacement units 204 and 206. In the case where multiple bodies or housings are used, each of the pistons 208 and 210 may have respective shafts (not shown) that are mechanically coupled, joined, linked, or otherwise operatively coupled to enable synchronized operation (e.g., pumping) of the displacement units 204 and 206. In any case, the mechanical coupling and, thus, synchronization of the operation of the displacement units 204 and 206 may eliminate the need to employ the relatively complex synchronization technique (i.e., momentary interruption of the displacement unit drawing fluid from the sample portion of the sampling probe) used in connection with the known system 100 of FIG. 1. In other words, the mechanical coupling and synchronization of the displacement units 204 and 206 in the example displacement unit assembly 202 serves to eliminate or substantially minimize pressure and flow pattern transients near the interface between the formation and the guard and sample inlets of a dual sampling probe, thereby eliminating or substantially minimizing the adverse affect of such transients on fluid separation (i.e., separation of filtrate from formation fluid) at the sampling probe/formation interface.

In the example system 200 of FIG. 2A, the displacement unit 204 is fluidly coupled to a guard flowline 214 via check valves 216,218, 220, and 222 to draw fluid from a guard portion of a sampling probe (not shown) and to convey the drawn fluid to a borehole annulus (not shown) in the direction of the arrow. Similarly, the displacement unit 206 is fluidly coupled to a sample flowline 224 via check valves 226, 228, 230, and 232 to draw fluid, for example, from a sample portion of the sampling probe and to convey the drawn fluid to, for example, a sample chamber or vessel (not shown) in the direction of the arrow. In contrast to the known system 100 of FIG. 1, the example pumpout system 200 includes a displacement unit control 234 that can measure the pressures in the guard and sample flowlines 214 and 224 via respective pressure sensors 236 and 238 and modulate respective flow control valves 240 and 242 to automatically and adaptively control the differential pressures and pumping rates provided by the displacement units 204 and 206. More specifically, at least partially opening the valve 240 provides a fluid path (e.g., a shunt having an optional flow restriction) between chambers 244 and 246 of the displacement unit 204, thereby reducing the differential pressure developed by the displacement unit 204 and reducing the effective pumping rate of the displacement unit 204 for the guard flowline 214. Similarly, at least partially opening the valve 242 provides a fluid path between chambers 248 and 250 of the displacement unit 206, thereby reducing the differential pressure developed by the displacement unit 206 and reducing the effective pumping rate of the displacement unit 206 for the sample flowline 224. A flow rate sensor may be added to advantage for monitoring the flow rate in the sample flowline 224 and/or the guard flowline 214 while any of the valves 240 and 242 are controllably operated.

Thus, in one example, the chambers 244 and 246 may have the same lengths as the chambers 248 and 250, but may have different cross-sectional areas to provide a desired intrinsic or base pumping distribution rate or pumping ratio between the guard and sample flowlines 214 and 224. In operation, the displacement unit control 234 can be then used (e.g., as a feedback controller) to control the degree to which the valves 240 and 242 are open/closed to vary the differential pressures and pumping rates of the displacement units 204 and 206 to achieve a desired pumping rate distribution or pumping ratio and/or to control (e.g., to minimize) the pressure across the inner packer (not shown) of the sampling probe. In contrast to the known system 100 of FIG. 1, the differential pressures developed by the displacement units 204 and 206 as well the pumping rates and pumping rate distribution provided thereby can be varied without having to change (e.g., replace) either of the displacement units 204 and 206 and/or the power supply (e.g., the power distribution) by, for example, removing and replacing the displacement units at the surface.

Further, the example system 200 also eliminates the minimum differential pressure and pumping rate limitations associated with the known system 100 of FIG. 1. In particular, the minimum differential pressure and/or pumping rates of the displacement units 204 and 206 are not based solely on the mechanical configurations of the displacement units 204 and 206 and/or the characteristics of the motor driving the units 204 and 206. Instead, the minimum differential pressures and/or pumping rates can be determined by the flow paths provided by the valves 240 and 242. For example, the greater the degree to which the valves 240 and 242 are open, the lower the flow restriction between the chambers 244 and 246 and the chambers 248 and 250. As the flow restriction between chambers is reduced, the differential pressures developed across the displacement units 204 and 206 are reduced. As a result, the range of differential pressures and pumping rates achievable with the example system 200 of FIG. 2A may be significantly greater than possible with the known system 100 of FIG. 1.

As noted/above, the pumpout system 200 is described herein in a configuration enabling for example a low shock sampling technique. However, the pumpout systems described herein may also be used for reverse low shock sampling techniques as well. In the example of FIG. 2A, the guard flowline 224 may be selectively fluidly connected to the back side of a sliding piston positioned in a sample collection vessel (not shown).

The example system 200 depicted in FIG. 2A can be implemented in various manners to achieve the same or similar results. For example, while two pressure sensors (i.e., the sensors 236 and 238 are shown as providing feedback information associated with the guard and sample flowlines 214 and 224 to the displacement unit control 234, more or fewer such sensors could be used instead. Additionally or alternatively, pressure sensors could be used to measure fluid pressures at different and/or additional points within the flowlines 214 and 224. Still further, different types of sensors such as, for example, fluid flow sensors could be used in addition to or instead of the pressure sensors 236 and 238.

The valves 240 and 242 may be implemented using any fluid valve suitable to vary the flow paths between the chambers 244 and 246 and the chambers 248 and 250. For example, a metering type valve (e.g., a sliding stem plug valve, a rotary valve such as a ball valve, etc.), a pressure relief valve, or any other suitable valve or combination of valves could be used to implement the valves 240 and 242.

The displacement unit control 234 may be implemented using a processor-based system (e.g., the processor-based system 1100 of FIG. 11) having a memory or other storage device or computer accessible medium or media to store software or other executable instructions or code, which can be executed by a processor to perform the methods or operations described herein. Alternatively or additionally, the displacement unit control 234 may include analog circuitry, digital circuitry, signal conditioning circuitry, power conditioning circuitry, etc. Still further, although the displacement unit control 234 is depicted in the example system 200 of FIG. 2A as being implemented as single block or device, some or all of the operations performed by the displacement unit control 234 may be performed by one or more devices or units located entirely downhole, entirely at the surface, or downhole and at the surface.

The mechanical synchronization and ability to adaptively vary the differential pressure and pumping rates of the displacement units 204 and 206 within the displacement unit assembly 202 in the example system 200 of FIG. 2A enables the example system 200 to be more flexibly adaptive to different, changing, and/or unpredictable formation characteristics, fluid types, drilling environments, etc. More specifically, conditions or properties such as uncertainty in the local flow pattern of a formation, contamination transport, depth of mud filtrate invasion, permeability anisotropy and viscosity, etc. can affect the displacement unit differential pressures and pumping rates at which a dual or guard probe provides its most effective fluid separation.

In one example, the system 200 can be configured (e.g., the displacement unit control 234 may be programmed) to pump out during a sample cleanup phase of operation in which the pumping rate(s) of the displacement unit assembly 202 is doubled relative to the pumping rate(s) used to collect the sample to be analyzed. Such a doubled pumping rate may be used in conjunction with a commingled pumpout mode (i.e., where fluid drawn in the from the sample and guard inlets is mixed or not separated). When the fluid drawn, from the formation reaches a desired purity level (i.e., the contamination level is acceptably low) after, for example, a predetermined time period or when a desired purity level is otherwise detected (e.g., using optical analysis), the displacement unit control 234 can automatically adjust (e.g., via the valves 240 and 242) the differential pressures and pumping rates of the displacement units 204 and 206 to achieve a desired pumping rate distribution (e.g., a pumping rate distribution that achieves a desired fluid separation at the interface between the sampling probe inlets and the formation). Additionally, during both the sample cleanup phase (during which the pumping rate is relatively high) and the sample production mode (during which an acceptably pure sample is taken for subsequent analysis), the displacement unit control 234 can monitor pressures in the flowlines 214 and 224 and provide appropriate responsive control signals to the valves 240 and 242 to ensure that the pressure developed across the inner packer (not shown) (i.e., a differential pressure across the inner packer) does not exceed a level that could compromise the integrity of the inner packer.

Figure 2B:
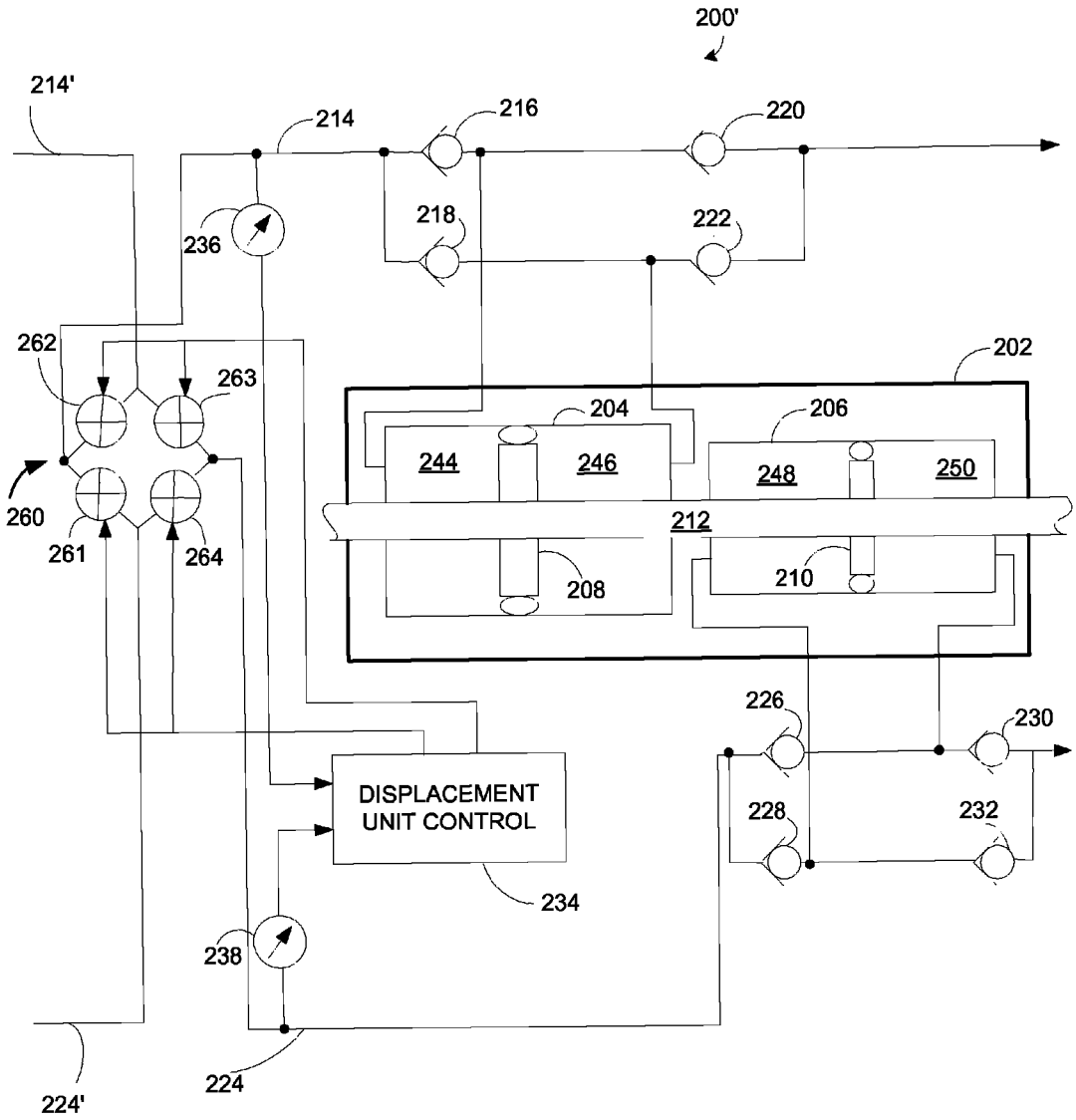
FIG. 2B is a schematic diagram of an alternative pumpout configuration having a dual displacement unit assembly where the pumped fluid can be routed independently to one or both displacement unit.

FIG. 2B is a schematic diagram of an alternative pumpout configuration 200' having a dual displacement unit assembly 202, where the pumped fluid can be routed independently to one or both displacement units. For brevity, the components of the pumpout configuration 200' that are similar to the pumpout configuration 200 are referred to with the same numeral. Also, some optional elements, such as valves 240 and 242 have not been repeated. In the configuration 200', the flowline 214 is not connected to a guard portion of a sampling probe, and the flowline 224 is not connected to a sample portion of a sampling probe. Instead, the flowlines 214 and 224 are fluidly connected to a fluid connector 260. Similarly, the fluid connector 260 is fluidly connected to flowlines 214' and 224'. The flow line 214' and 224' may be in turn fluidly connected to a guard portion and a sample portion of a sampling probe, respectively. The fluid connector 260 may comprise one or more valves or restrictors that may be used to vary the flow rate in flow lines 214' and/or 224', as further detailed below.

In the shown example, the fluid connector 260 comprises four valves 261, 262, 263, and 264, controlling the flow between flowlines 224' and 214, 214' and 214, 214' and 224, and 224' and 224, respectively. In a first exemplary operational mode, the valves 262 and 263 of the fluid connector 260 are closed, and the valves 261 and 264 of the fluid connector 260 are open. In this operational mode, fluid is drawn from the flowline 224' by both displacement units 204 and 206, and no fluid is drawn from the flowline 214'. This operational mode may be used to advantage for forcing a high flow rate at the sample inlet or portion of a guarded probe. In a second exemplary operational mode, the valves 262 and 263 of the fluid connector 260 are open, and the valves 261 and 264 of the fluid connector 260 are closed. In this operational mode, fluid is drawn from the flowline 214' by both displacement units 204 and 206, and no fluid is drawn from the flowline 224'. This operational mode may be used to advantage for forcing a high flow rate at the guard inlet or portion of a guarded probe. In a third exemplary operational mode, the valves 261, 262, 263 and 264 of the fluid connector 260 are open. In this operational mode, fluid is drawn from the flowline 214' and 224' simultaneously by both displacement units 204 and 206. This operational mode may be used to advantage for achieving a flow rate regime at the guard inlet and the sample inlet of a guarded probe that minimize the pressure differential across the guard inlet and the sample inlet. In a forth operational mode, the valves 262 and 264 of the fluid connector 260 are open, and the valves 261 and 263 of the fluid connector 260 are closed. In this operational mode, fluid is drawn from the flowline 214' by the displacement unit 204 and fluid is drawn from the flowline 224' by the displacement unit 206. This operational mode may be used to advantage for achieving a flow rate regime at the guard inlet and the sample inlet of a guarded probe that corresponds to the characteristics of the displacement units 204 and 206 respectively. It should be understood that these operational modes are given for illustration purposes, and that other operational modes may be achieved by manipulating the valves of the fluid connector 260 and/or modifying the layout and the number of valves included in the fluid connector 260, as desired.

During a sampling operation, it may be useful to switch from one operational mode to another, thereby varying the flow rate in flow lines 214' and/of 224'. The switch may be piloted under control of the displacement unit control 234, in a predetermined manner, or based on measurement collected by sensors in the tool, such as sensors 236 and 238, or other sensors. The displacement unit control may initiate the switch automatically or under commands received by a surface operator. Further, it should be noted that the displacement unit control may be capable of partially opening or closing valves in the fluid connector 260, to achieve a plurality of operational modes. For example, in another operational mode, the valves 261, and 264 of the fluid connector 260 are open, and the valves 262 and 263 are partially closed, causing a pressure drop between the flowline 214' and the flowline 224'.

Figure 3:
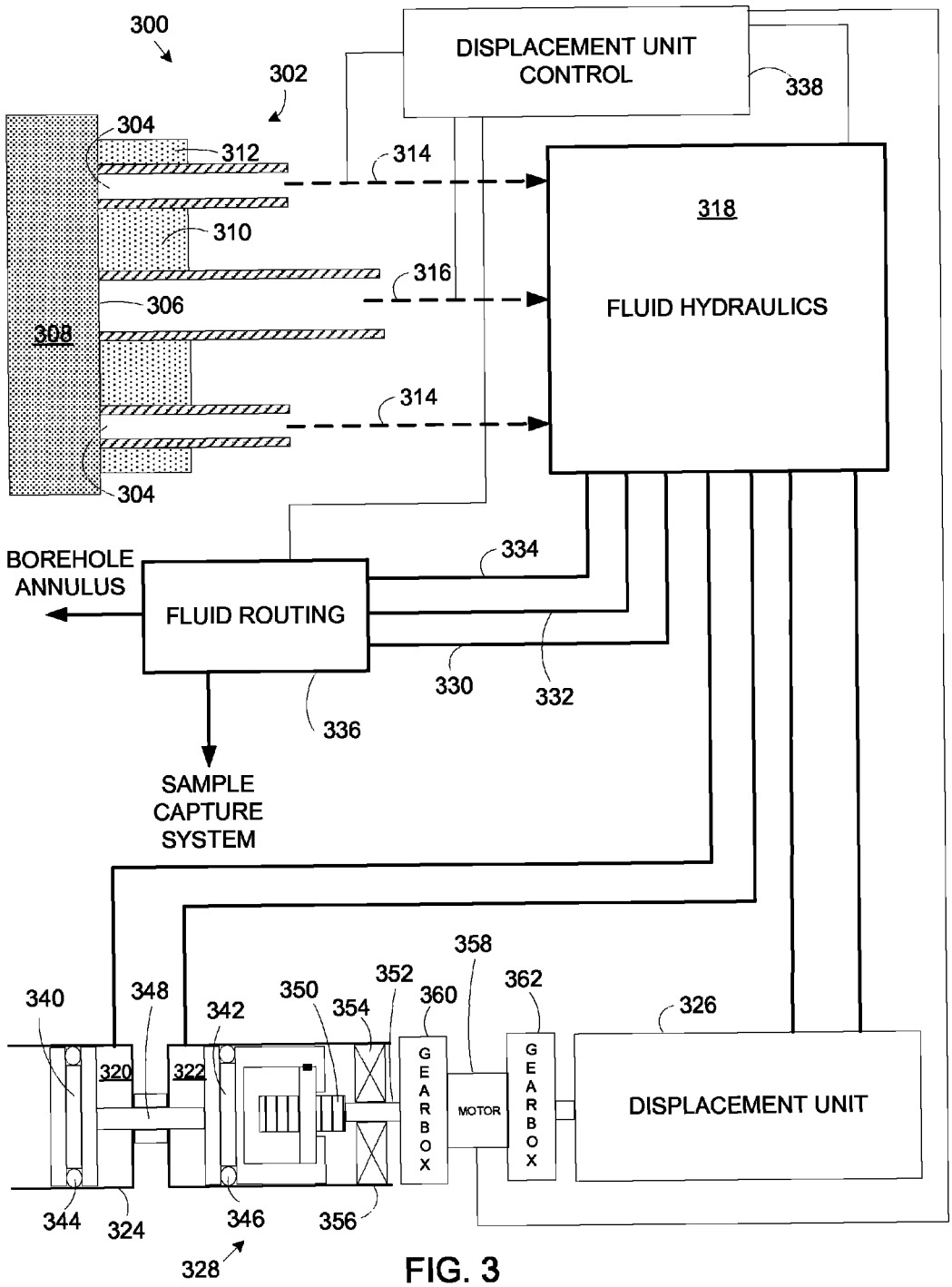
FIG. 3 is a schematic diagram of an example focused sampling system that may be implemented using a pumpout configuration having a dual displacement unit assembly.

FIG. 3 is a schematic diagram of an example focused sampling system 300 that may be implemented using a pump-out configuration having a dual displacement unit system. As depicted in FIG. 3, a dual or guard sampling probe 302 having a guard nozzle, inlet, or portion 304 and a sample nozzle, inlet, or portion 306 is disposed adjacent to a formation 308 from which a fluid sample is to be drawn and analyzed. The sampling probe 302 includes concentric inner and outer packers 310 and 312, which may be implemented in any conventional or known manner.

A guard flowline 314 and sample flowline 316 associated with the guard and sample inlets 304 and 306, respectively, are fluidly coupled to a fluid hydraulics block 318. The fluid hydraulics block 318 is configured to manage the distribution of the flowlines 314 and 316 to chambers (e.g., 320 and 322) within displacement units 324 and 326 Of a displacement unit assembly 328. The fluid hydraulics block 318 may be implemented using check valves (e.g., mud check valves) such as the arrangement of the check valves 216, 218, 220, 222, 226, 228. 230, and 232 shown in FIG. 2A. Also, generally, the displacement unit assembly 328 corresponds to the displacement unit assembly 202 and the displacement units 324 and 326 correspond to the displacement units 204 and 206, respectively, shown in FIG. 2A. However, as described in greater detail below, the example displacement unit assembly 328 represents one particular implementation of the displacement unit assembly 202 of FIG. 2A.

In addition to routing the flowlines 314 and 316 to the displacement units 324 and 326, the fluid hydraulics block 318 also conveys outputs 330 and 332 from the displacement units 324 and 326, and a bypass line 334 to a fluid routing block 336 which, in turn, can selectively route fluid to the borehole annulus and/or a sample capture system (not shown). To control the operations of the example system 300, a displacement unit control 338 is provided. The displacement unit control 338 may be similar or identical to the displacement unit control 234 described in connection with FIG. 2A-2B. Thus, the displacement unit control 338 may be eon figured to monitor or measure the pressures (e.g., via pressure sensors (not shown)), within the flowlines 314 and 316 and adaptively control the operations of the displacement unit assembly 328 to vary or control the differential pressures, pumping rates, and/or pumping rate distribution provided by the displacement unit assembly 328. Additionally, the displacement unit control 338 may control the fluid routing block 336 to, for example, route all fluid drawn via the sampling probe 302 to the borehole annulus during a sample cleanup mode or phase and to the borehole annulus and the sample capture system during a sample collection mode or phase.

Turning in more detail to the displacement unit assembly 328, the displacement unit 324 is depicted as a roller screw type pump. Although not depicted in FIG. 3, the displacement unit 326 may be configured identically or similarly to the displacement unit 324 and, thus, may also be a roller screw type pump. Alternatively, the displacement unit 326 may use a different pump configuration than the displacement unit 324. As can been seen in FIG. 3, the displacement unit 324 includes pistons 340 and 342 having respective sliding seals 344 and 346. The pistons 340 and 342 are also mechanically or operatively coupled via a shaft 348 and, thus, reciprocate in unison or synchronously in response to rotation of a roller screw 350. A shaft 352 extending from the roller screw 350 is supported by bearings 354 and 356 and driven via a motor 358 through a gearbox 360. As shown in FIG. 3, the displacement unit 326 may be coupled to the motor 358 through another gearbox 362. Optionally, a clutch may be used between the motor 358 and the gearbox 362, and/or between the motor 358 and the gearbox 360.

The gearboxes 360 and 362 may be selected to provide a desired torque/speed characteristic and may be implemented using a fixed gear ratio (e.g., a reduction or n:1 ratio) or a continuously variable type of configuration. The motor 358 may be directly coupled to the gearboxes 360 and 362 or, alternatively, may be coupled to the gearboxes 360 and 362 via clutches. In configuration shown in FIG. 3, the motor 358 may have dual shafts, which extend from opposite ends of the motor 358 and, thus, in ease where there is no interposing clutch between the motor 358 and the gearboxes 360 and 362, the displacement units 324 and 326 always operate in a mechanically synchronous manner. In other words, when the motor 358 is operational, the shafts of the motor 358 cause the displacement units 324 and 326 to pump in a synchronized manner. However, other configurations using a clutch that interposes between the motor 358 and the gearboxes 360 and/or 362, allow fully independent control of the pumping rate for the guard and sample flowlines 314 and 316. Alternatively, although not depicted in FIG. 3, each of the displacement units 324 and 326 may be driven by a respective, separate motor (e.g., similar or identical to the motor 358).

The example system 300 depicted in FIG. 3 may, for example, be used to provide a sampling while drilling system. In particular, the example system 300 may be implemented within a tool string as part of, for example, a bottom hole assembly. Also, the example system 300 may utilize its ability to adaptively vary the differential pressures and/or pumping rates of the displacement units 324 and 326 to provide a substantially pure or contamination free sample in a relatively short sample time, thereby reducing the possibility of sticking during drilling operations. In one example implementation, the displacement unit control 338 may control the pumping rates of the displacement units 324 and 326 to be at their maximum levels during the beginning of a sampling procedure and then adaptively adjust the pumping rates to achieve a lowest possible contamination level (i.e., highest purity) sample fluid in the shortest possible time. In some examples, the contamination history of the formation fluid (e.g., as provided by an optical fluid analyzer) may be used to adaptively adjust the pumping rates and pumping distribution of the displacement units 324 and 326 to achieve a pumping rate or ratio that provides a sampling probe focus that achieves a desirably or sufficiently low sample contamination level.

In the example shown in FIG. 3, the base or intrinsic, pumping rate of the displacement units 324 and 326 can be configured by adjusting certain mechanical parameters such as, for example, the ratios of the gearboxes 360 and 362, adjusting the pitch of the roller screws (e.g., the roller screw 350), configuring the effective cross-sectional areas of the chambers (e.g., the chambers 320 and 322). With the example in FIG. 3, the foregoing displacement unit mechanical parameters can be set independently and, thus, differently for each of the displacement units 324 and 326 to achieve a desired base pumping rate distribution or ratio. In the case where clutches are used between the gearboxes 360 and 362 and the displacement units 324 and 326, the clutches may be engaged/disengaged to vary the duty cycle (i.e., the clutches may be used to vary the duty cycle of the displacement units 324 and/or 326). Further adaptive variations to the pumping rates and pumping rate distribution can then be implemented by controlling the fluid hydraulics block 318 to vary the differential pressure across the displacement units 324 and 326 as previously discussed.

Figure 4:
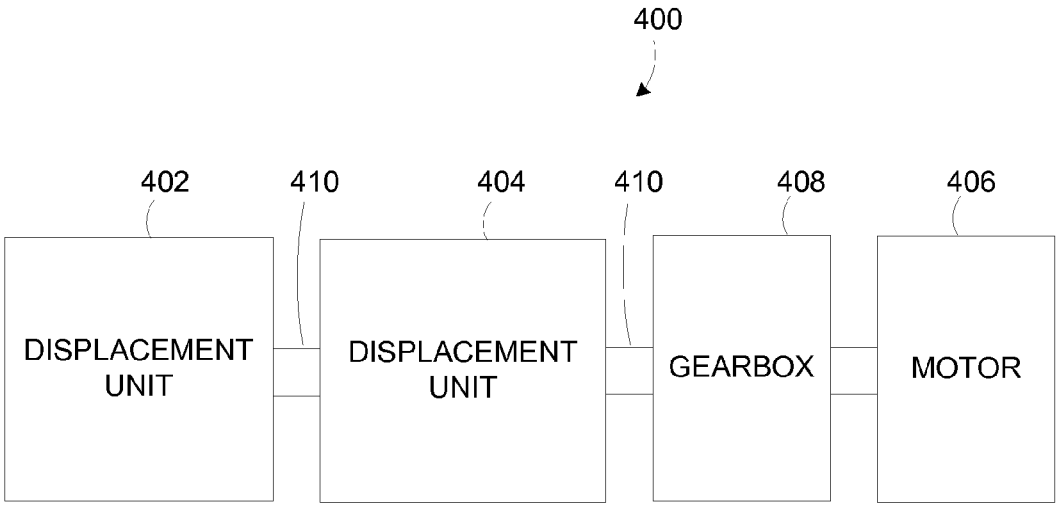
FIG. 4 is an alternative dual displacement unit configuration that may be used to implement the example focused sampling system of FIG. 3.

FIG. 4 is an alternative displacement unit configuration 400 that may be used to implement the example displacement unit assembly 328 of FIG. 3. In contrast to the example displacement unit assembly 328 of FIG. 3, the example system 400 includes two displacement units 402 and 404 that are driven via a motor 406 by a common gearbox 408 and shaft 410. In the example system 400, the displacement units 402 and 404, the gearbox 408, and the motor 406 may be implemented using devices similar or identical to those described in connection with FIG. 3 above. However, because the displacement units 402 and 404 share a common shaft, a single roller screw assembly and gearbox can be used instead of having to provide two roller screw assemblies and two gearboxes. Thus, while the flow provided to guard and sample flowlines by the example system 400 is synchronous with the reciprocating motion of the single roller screw, the base or intrinsic flow rate or pumping rates and pumping rate distribution is adjusted by varying the effective areas of the chambers within the displacement units 402 and 404. Of course, as with the example system 300 of FIG. 3, further adaptive adjustments to the pumping rates and pumping rate distribution can be performed by the fluid hydraulics block 318 and the displacement unit control 338 as described above.

In yet another example, the example pumpout system described herein may be implemented using a mixed variety of actuator types for driving them. In particular, one of the displacement units may be driven using, for example, a motor driven gearbox and a roller screw such as that described in connection with FIG. 3 above. The other displacement unit may be hydraulically driven in a manner similar to the displacement units used in the Schlumberger Modular Formation Dynamics Tester (MDT). In this example, a single electric motor may be used to drive the gearbox and its associated displacement unit and, a hydraulic oil pump (e.g. a fixed displacement hydraulic oil pump), which generates a high pressure oil to drive its associated displacement unit. In addition, the displacement units disclosed herein are not limited to the disclosed reciprocating piston, but may include any type of displacement unit able to accomplish the intended purpose, including but not limited to centrifugal type pumps or Moineau type pumps. If desired, the pumpout system may be controlled using feedback from an optical fluid analyzer and/or a flow meter.

Figure 5A:
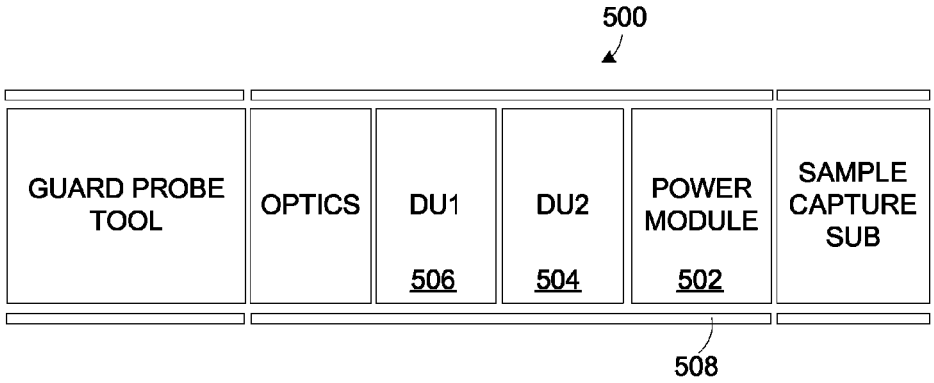
FIGS. 5*a*, 5*b*, and 5*c* depict various tool topologies employing the example methods and apparatus described herein.
Figure 5B:
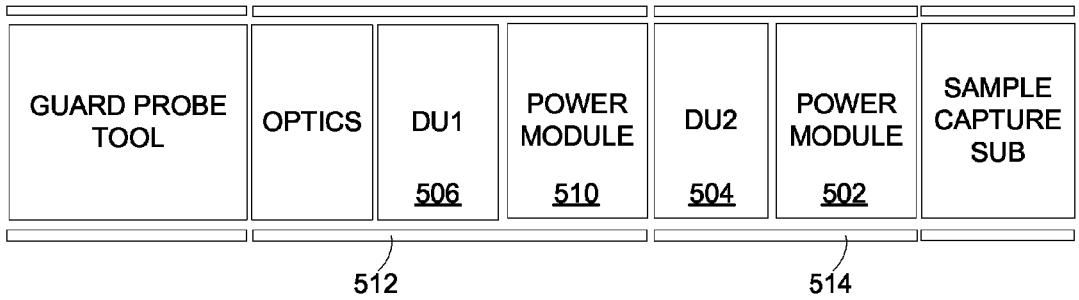
Figure 5C:
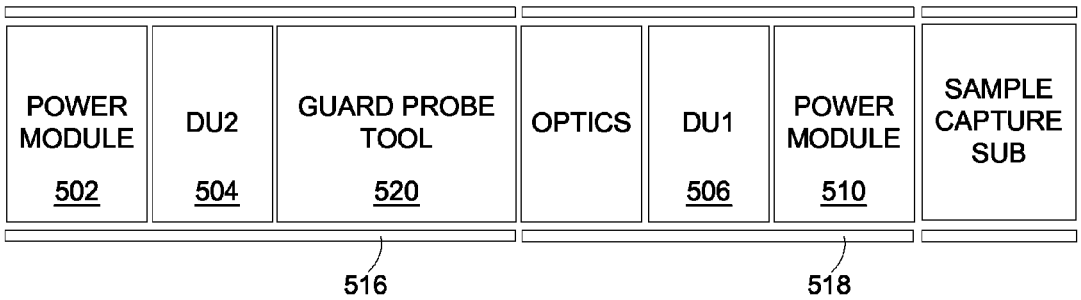

FIGS. 5*a*, 5*b*, and 5*c* depict various tool topologies employing the example methods and apparatus described herein. In the FIGS. 5*a*-5*e*, the guard probe tool would be preferentially, but not necessarily, as close as possible to the bottom of the well. FIG. 5*a* depicts a relatively compact configuration 500 that includes a single power module or section 502 that powers two displacement units 504 and 506, which may be installed in one collar 508, and which may be similar to the examples shown in FIGS. 3 and 4. In FIG. 5*b*, a second power module 510 is provided and the displacement units 506 and 504 are mounted with their respective power modules 510 and 502 in separate collars 512 and 514. In FIG. 5*c*, the displacement units 504 and 506 are contained in separate collars 516 and 518, where the collar 516 also contains a guard probe tool 520. In the illustration of FIGS. 5*a*-5*c*, a sample flowline (not shown) fluidly connects a sample inlet of a guarded probe extendable from the guard probe tool extends to a sample capture sub. The fluid in this flowline may be drawn with the displacement unit 506. Still in the illustration of FIGS. 5*a*-5*b*, a guard flowline (not shown), fluidly connects the guard inlet of a guarded probe extendable from the guard probe tool to an exit port (e.g. to the wellbore) in the module 504. The fluid in this flowline may be drawn with the displacement unit 504.

The tools topologies illustrated in FIGS. 5*a*-5*c* are equally applicable for any means of conveyance known by those skilled in the art. However, it should be noted that the power module may differ according to the power source available with any particular conveyance mean. For example, if power is provided to the tool through a wireline cable, the power module may include a current or voltage transformer, and/or voltage surcharge protection. In other examples, power may be provided through fluid circulation through a conduit (e.g., a drill string bore) via a turbine and an alternator.

The foregoing example adaptive focused formation fluid sampling apparatus and methods utilize displacement units or displacement unit assemblies for which the differential pressures, pumping rates, and/or pumping ratios or distribution can be adaptively varied to provide more rapid sample cleanup and increased sample purity (or reduced contamination) in comparison to known sampling apparatus and methods. In general, the foregoing example apparatus and methods utilize valves (e.g., acting as shunts) coupled between the chambers of displacement units to enable the flow of fluid between the chambers (e.g., a recirculation path) and thereby vary the differential pressures across the chambers as well as the pumping rates of the displacement units. A displacement unit control may be used to provide feedback control (e.g., by measuring flowline pressures) to adaptively control the degree to which the valves are open/closed to vary the differential pressures and pumping rates to achieve a desired fluid separation, to minimize the differential pressure across the inner packer, etc.

However, the effective displacements provided by the foregoing example displacement units is substantially fixed (i.e., cannot be adaptively varied) given the mechanical configurations of those units. Additionally, in a case where a displacement unit (e.g., known displacement units and/or the example displacement units described herein) is driven by a hydraulic motor, the hydraulic motor also typically provides an effective displacement that is substantially fixed given its mechanical configuration. Thus, whether a displacement unit is configured for use as a pump (e.g., to extract formation fluid as discussed in connection with FIGS. 1-5 above) or a motor (e.g., to drive another displacement unit that is acting as a pump), these displacement units typically have a substantially fixed displacement. Thus, traditionally, when selecting a displacement unit for use as a pump (e.g., to extract formation fluid) or motor, a displacement unit having a particular mechanical configuration that provides a desired basic or intrinsic pumping force, displacement, pumping rate, etc, is selected. As a result, if it is later determined (e.g., after attempting to use the displacement unit in its intended application) that the displacement unit fails to provide sufficient (or provides an excessive) pumping force, displacement, pumping rate, etc., it may be necessary to remove the tool from the borehole and replace the displacement unit with one having a different mechanical configuration that provides an acceptable performance.

The methods and apparatus described below in connection with FIGS. 6-9 may be used to vary the effective fluid displacement of a displacement unit being driven by a hydraulic pump and/or a linear motor. In contrast to known (i.e. fixed displacement) displacement units, the displacement units described in connection with FIGS. 6-9 below provide a plurality of selectable piston chambers haying different volumes that enable the effective displacement of the displacement units to be varied to suit the needs of a particular application. In this manner, a single variable displacement unit can be configured to have a plurality of different effective displacements to satisfy the needs of a relatively wide range of applications. Additionally, the example variable displacement units described in connection with FIGS. 6-9 can be driven or fed via a fixed displacement pump or a linear motor to provide a selectably variable displacement and flow rate that could not otherwise be provided directly by the fixed displacement motor or pump. In light of the above and the brevity of the description, the embodiments shown in FIGS. 6-9 will be described herein as single displacement units 600, 900 driven by a shaft 603, 903 coupled to a linear motor 601 and 901, respectively. The single displacement units 600, 900 may also be coupled to a second or complimentary displacement unit via the same or similar shaft coupled to the motor, thereby achieving synchronized displacement units.

Figures 6, 7:
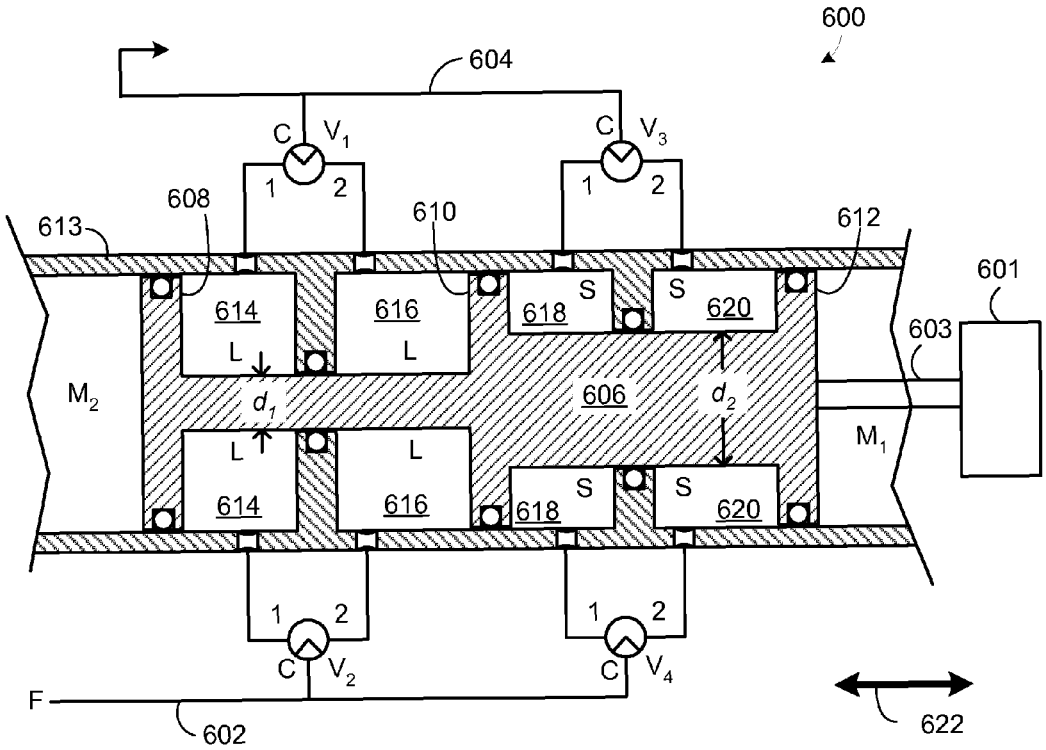
FIG. 6 illustrates an example variable displacement unit comprising a dual displacement unit.
FIG. 7 is a table illustrating the various operational modes that can be provided by the example variable displacement unit of FIG. 6.

FIG. 6 illustrates an example variable (i.e., variable displacement and flow rate) displacement unit 600 that is fluidly coupled to the linear motor 601 via the shaft 603. The linear motor 601 may be implemented with a rotation motor, a gearbox, and a roller screw as mentioned above. When used as a pump, a flowline 602 may be fluidly coupled to the formation and the flowline 604 may be fluidly coupled to an interior of the tool, including for example a sample chamber, a exit port to the wellbore, etc. (not shown). As such, the displacement unit 600 may be used to pump formation fluid, such as guard or sample fluid from the formation, whereas a complimentary displacement unit (not shown) may pump the other of the guard or sample fluid from the formation. The variable displacement unit 600 includes a plurality of independently controllable three-way two-position valves V1-V4. The variable displacement unit 600 also includes a piston rod 606 and pistons 608, 610, and 612, which are slidably engaged with a body or housing 613 to form chambers 614, 616, 618, and 620. As described in more detail below, the chambers 614, 616, 618, and 620 may be selectively filled via the valves V1, V2, V3, and V4 with formation fluid from the flowline 602 as the pistons 608, 610, and 612 move in a reciprocating motion in directions generally indicated by arrows 622. In operation, the motor 601 provides the forces or motion needed to reciprocate the shaft 603 and piston rod 606 to perform a pumping application. The chambers M1 and M2 may be filled with hydraulic fluid maintained at or slightly above wellbore pressure via a compensator (not shown).

In the illustrated example, the piston rod 606 has a first portion having a diameter $d_1$ and a second relatively larger portion having a diameter $d_2$. As can be seen in FIG. 6, the difference in the diameters $d_1$ and $d_2$ results in the displacements of the chambers 614 and 616 being different (e.g., greater) than the displacement of the chambers 618 and 620. Further, with the example configuration shown in FIG. 6, the difference in displacements that results from the differing piston rod diameters enables the variable displacement unit 600 to be configured (by controlling the valves V1-V4) to provide two different effective displacements (or flowrates) in a reciprocating action. More specifically, the valves V1-V4 can be controlled to route hydraulic fluid from the flowline 602 so that the effective displacement of the variable displacement unit 600 equals the sum of the displacements of the chambers 616 and 620 (when the piston rod 606 moves toward M1) and the sum of the displacements of the chambers 614 and 618 (when the piston rod 606 moves toward M2). Alternatively, the valves V1-V4 may be controlled so that the effective displacement of the variable displacement unit 600 equals the difference of the displacements of the chambers 616 and 618 (when the piston rod 606 moves toward M1) and the difference of the displacements of the chambers 614 and 620 (when the piston rod 606 moves toward M2). Still further, the valves V1-V4 may be controlled to provide the greater effective displacement (i.e., a sum of displacements) in one direction of motion of the piston rod 606 and the relatively lower effective displacement (i.e., a difference of displacements) in the other direction of motion.

In the illustrated example of FIG. 6, the variable displacement unit 600 is a reciprocating unit. However, in other example implementations, the variable displacement unit 600 may be a rotary unit. Additionally, although the displacement unit 600 is depicted as being coupled to the motor 601 and the shaft 603, in other example implementations, the displacement unit 600 may instead be coupled to a hydraulic (e.g. fixed displacement) pump (not shown). For example, the chambers M1 and M2 may be used to provide the forces or pressures needed to extract fluid from a formation, thereby eliminating the need for the motor 601 and shaft 603.

FIG. 7 is a table illustrating the various operational modes that can be provided by the example variable displacement unit 600 of FIG. 6. As shown in FIG. 7 there are four distinct operational modes, each of which is defined by a unique configuration of the valves V1-V4. In MODE 1, for example, the valve V1 is set so that fluid can flow from port C to port 1 and the chamber 614, the valve V2 is set so that fluid can flow from port C to port 2 and the chamber 616, V3 is set so that fluid can flow from port C to port 1 and the chamber 618, and V4 is set so that fluid can flow from port C to port 2 and the chamber 620. In this example, the chambers 614 and 616 are assumed to provide a displacement of "L" and the chambers 618 and 620 are assumed to provide a displacement of "S," where S is less than L. Thus, in MODE 1, formation fluid from the flowline 602 flows into the chambers 616 and 620, urges the piston rod 606 displacement toward the chamber M1. Additionally, in MODE 1, the effective displacement of the variable displacement unit 600 equals the sum of the displacements of the chambers 616 and 620 (i.e., L+S). Additionally, MODE 2 provides an effective displacement of L−S for piston rod travel in the direction of M1, MODE 3 provides an effective displacement of L+S for piston rod travel in the direction of M2, and MODE 4 provides an effective displacement of L−S for piston rod travel in the direction of M2.

Figure 8:
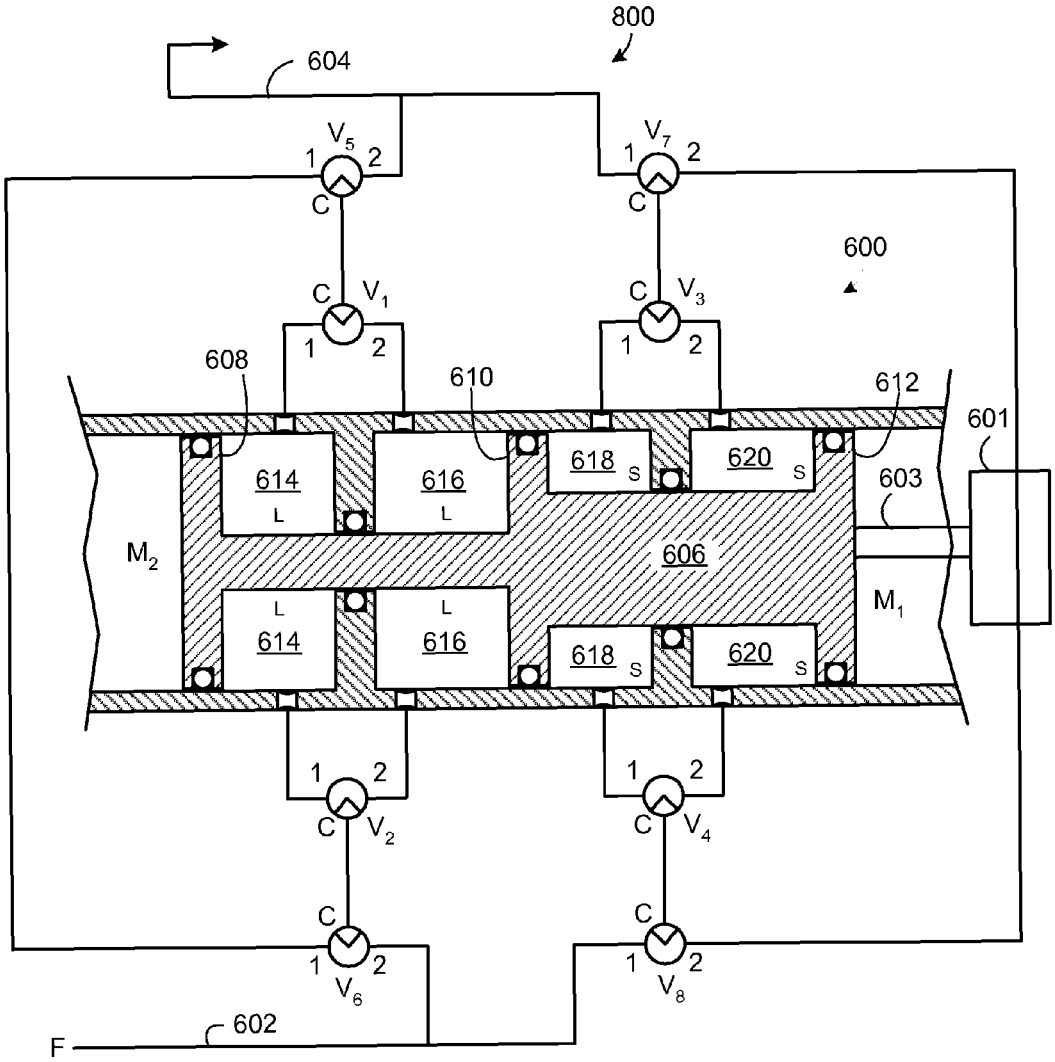
FIG. 8 depicts another variable displacement unit configuration.

FIG. 8 depicts another variable displacement unit configuration 800 that provides two additional (for a total of four) effective displacements. In general, the configuration 800 includes the variable displacement unit configuration 600 of FIG. 6 and four additional three-way valves V5, V6, V7, and V8. The valves V5 and V6 can be set to enable fluid from the flowline 602 to bypass the chambers 614 and 616 to provide an effective flowrate of S and, alternatively, the valves V7 and V8 can be set to enable the chambers 618 and 620 to be bypassed to provide an effective flowrate of L. Thus, with the example configuration 800 of FIG. 8, the valves V1-V8 can be set to provide effective flowrates of L, S, L−S, and L+S in both directions of travel of the piston rod 606 (i.e., in a reciprocating motion). While the example configuration 800 of FIG. 8 depicts four additional three-way valves, if desired, only two additional three-way valves (i.e., V5 and V6 or V7 and V8) could be used to provide just one additional (for a total of three) effective flowrates. Further, it will be appreciated by those versed in the art that some or all the three-way valves V1-V8 may be implemented with combinations of two way valves and check valves, or other kind of valves providing a similar functionality.

Figure 9:
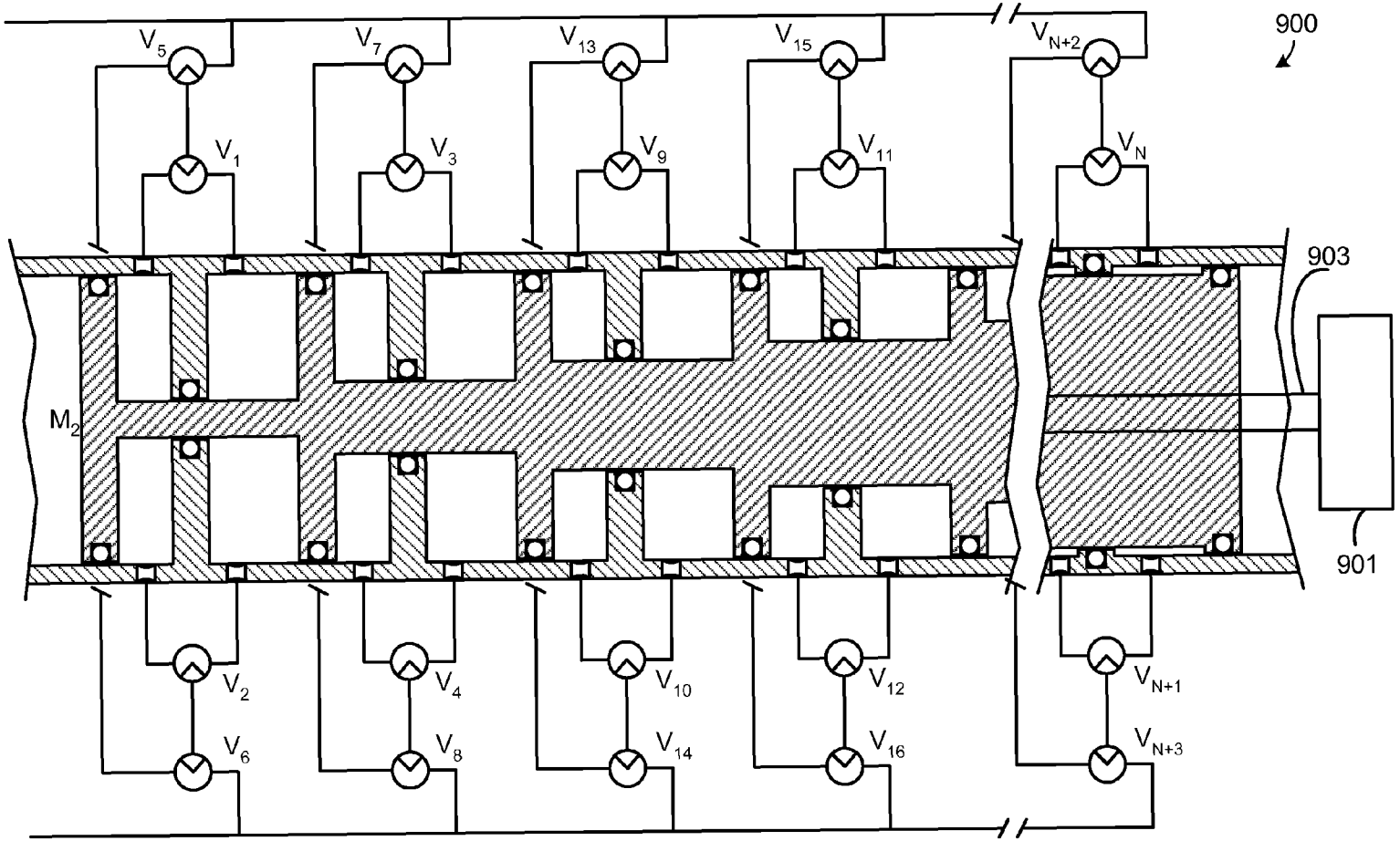
FIG. 9 schematically depicts a variable displacement unit configuration that incorporates more than four chambers.

FIG. 9 schematically depicts a variable displacement unit configuration 900 that incorporates more than four chambers. As shown in FIG. 9, the example configuration 900 can include any desired number of chambers and associated fluid routing and bypass valves to achieve any desired number of different effective displacements.

Figure 10:
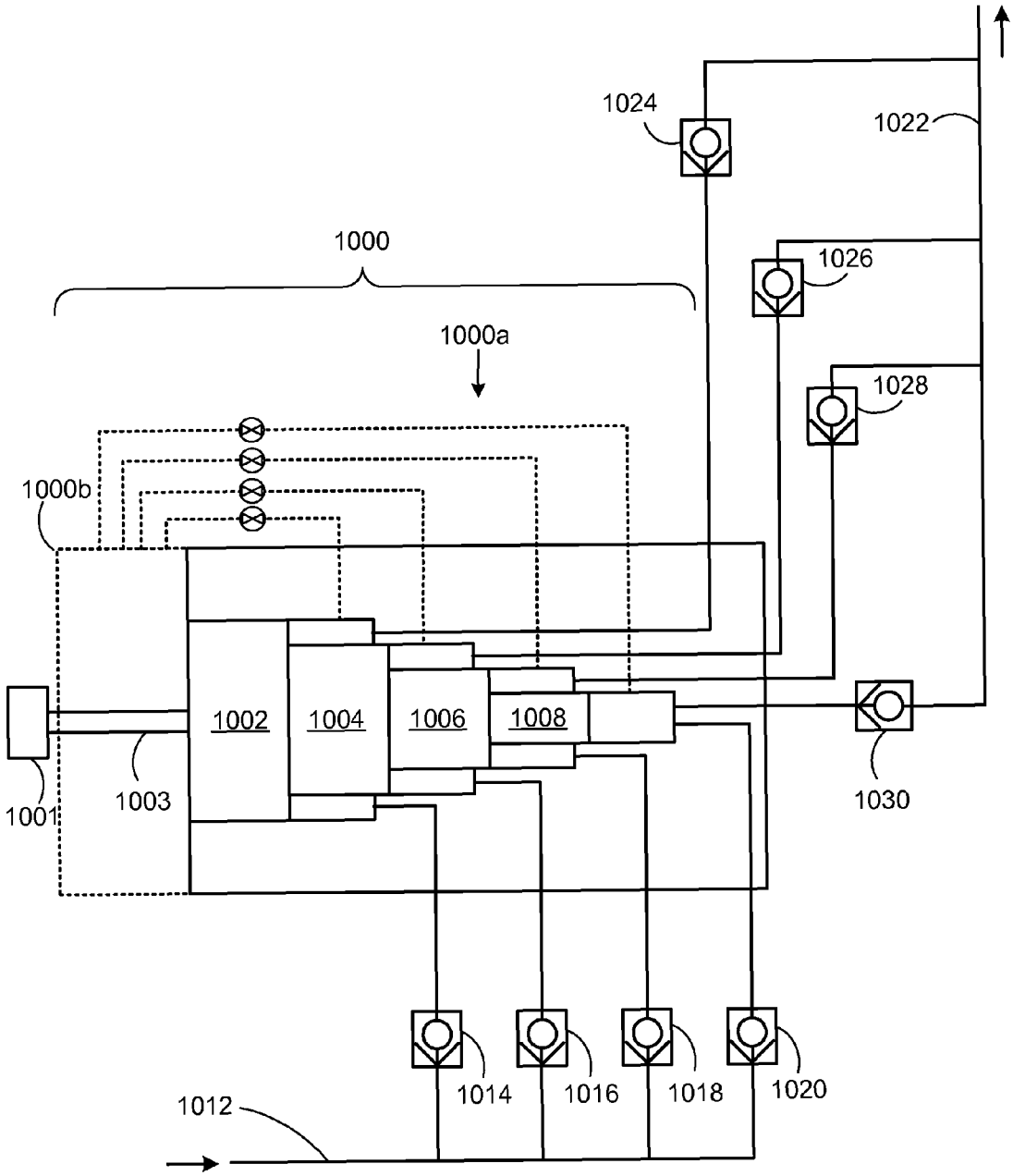
FIG. 10 depicts yet another example variable displacement unit.

FIG. 10 depicts yet another variable displacement unit configuration 1000. In particular, FIG. 10 depicts a first portion 1000*a* that may be used in combination with a second portion 1000*b* to create a first displacement unit 1000. With the addition of the second portion 1000*b*, such as through a shaft 1003 or through direct affixation, the displacement unit 1000 will operate, with some additional valves as depicted in FIG. 2A, to provide a continuous flow.

In addition, the displacement unit 1000 may be coupled to a second or complimentary displacement unit 1001, via the shaft 1003 for example, thereby achieving synchronized displacement units. As such, the displacement unit 1000 may be used to pump formation fluid, such as guard or sample fluid from the formation, whereas a complimentary displacement unit 1001 may pump the other of the guard or sample fluid from the formation. The example displacement unit 1000 shown in FIG. 10 may, for example, be used to implement the displacement units described in connection with FIGS. 2-5. In general, the example portion 1000*a* is configured to adjust its effective displacement or flowrate of sample fluid that is being drawn from a formation.

Turning in detail to FIG. 10, the example portion 1000*a* includes a plurality of piston displacement units 1002, 1004, 1006, and 1008, each of which provides a different flowrate. As depicted in FIG. 10, the pistons displacement units 1002, 1004, 1006, and 1008 are mechanically coupled (e.g., chained) to each other and the common shaft 1003. In unison or a mechanically synchronized manner, each of the piston displacement units 1002, 1004, 1006, and 1008 draws fluid from an inlet flowline 1012 via respective check valves 1014, 1016, 1018, and 1020 when the shaft 1003 is moved to the left in the illustrated example. As the shaft 1003 is moved back to the right in the illustrated example, the fluid previously drawn in by the displacement units 1002, 1004, 1006, and 1008 is forced under pressure into an outlet flowline 1022 via respective check valves 1024, 1026, 1028, and 1030. In operation, one of the displacement units 1002, 1004, 1006, and 1008 provides a best (e.g., a substantially optimal) displacement for the pressure and/or flowrate of the sample fluid. However, those of the units 1002, 1004, 1006, and 1008 that do not provide the best displacement (e.g., all but one) can continue to pump fluid between their respective counterpart units in portion 1000*b* to avoid any unnecessary pressure build-ups in the unused units. Similarly, any of the units 1002-1008 may be used in combination to obtain a variety of flow rates and/or pressures.

Figure 11:
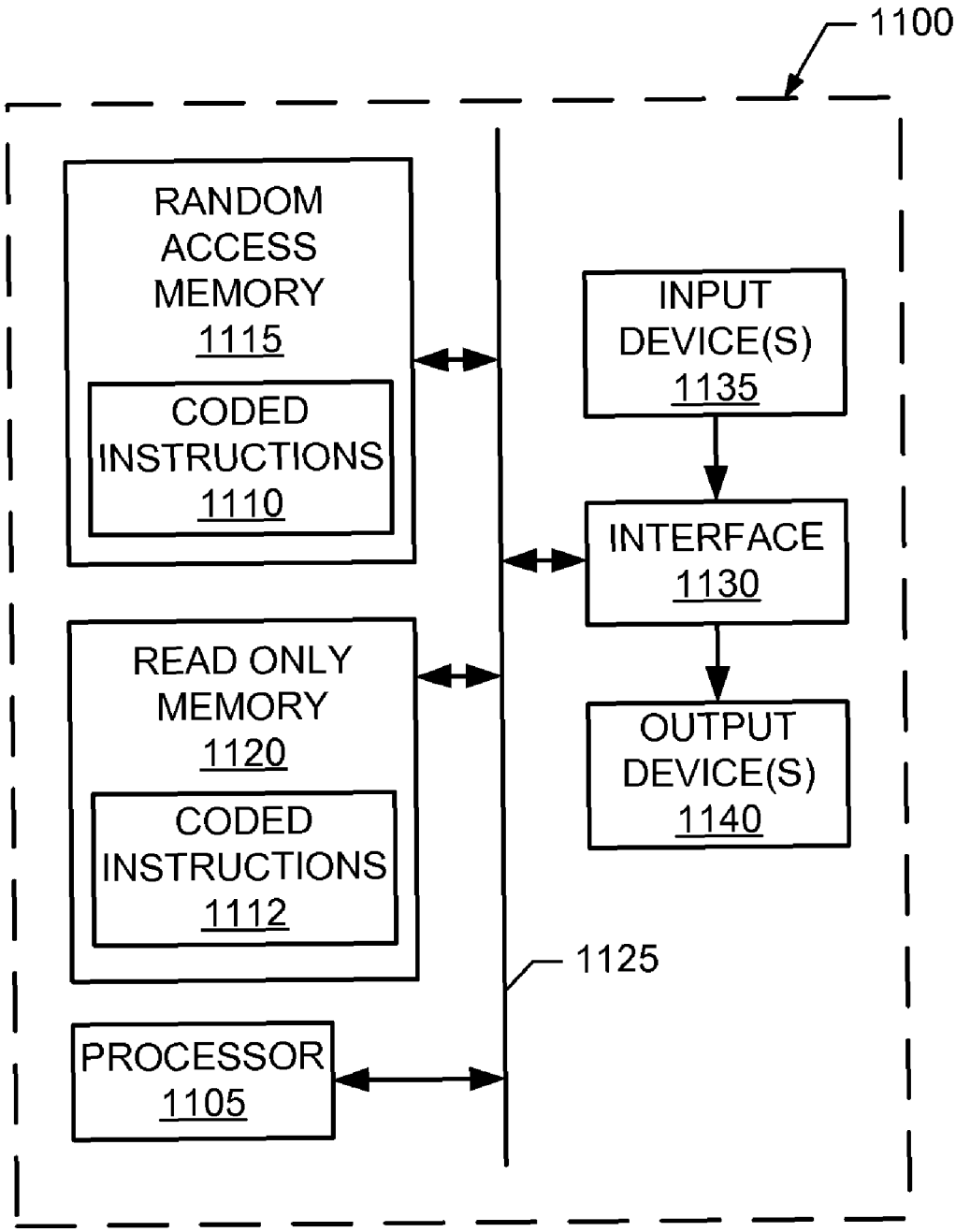
FIG. 11 is a schematic diagram of an example processor platform that may be used and/or programmed to implement any or ail example apparatus and methods described herein.

FIG. 11 is a schematic diagram of an example processor platform 1100 that may be used and/or programmed to implement any or all example apparatus and methods described herein. In particular, the example processor platform 1100 may be used to implement the example displacement unit control 234 of FIG. 2A-2B and/or the example displacement unit control 338 of FIG. 3. Further, the processor platform 1100 can be implemented by one or more general purpose processors, processor cores, microcontrollers, etc.

The processor platform 1100 of the example of FIG. 11 includes at least one general purpose programmable processor 1105. The processor 1105 executes coded instructions 1110 and/or 1112 present in main memory of the processor 1105 (e.g., within a RAM 1115 and/or a ROM 1120). The processor 1105 may be any type of processing unit, such as a processor core, a processor and/or a microcontroller. The processor 1105 may execute, among other things, the example processes described herein such as, for example, adaptively controlling one or more displacement units to extract a formation fluid sample, and/or to more quickly reduce the contamination level of a formation fluid sample. The processor 1105 is in communication with the main memory (including a ROM 1120 and/or the RAM 1115) via a bus 1125. The RAM 1115 may be implemented by DRAM, SDRAM, and/or any other type of RAM device, and ROM may be implemented by flash memory and/or any other desired type of memory device. Access to the memory 1115 and 1120 may be controlled by a memory controller (not shown).

The processor platform 1100 also includes ah interface circuit 1130. The interface circuit 1130 may be implemented by any type of interface standard, such as a USB interface, a Bluetooth interface, CAN interface, an external memory interface, serial port, general purpose input/output, etc. One or more input devices 1135 and one or more output devices 1140 are connected to the interface circuit 1130. The input devices 1135 and/or output devices 1140 may be used to receive sensor signals (e.g., from one or more pressure or flow sensors) and/or to control one or more valves.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness. Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An apparatus, comprising:

a downhole tool configured for conveyance within a wellbore extending into a subterranean formation, the downhole tool comprising:

a sampling probe configured to couple with a sidewall of the wellbore adjacent the formation and draw a fluid sample from the formation;

a displacement unit assembly comprising:

a plurality of chambers including two first chambers and two second chambers; and first and second pistons coupled to a shaft for synchronous movement upon movement of the shaft, wherein the first piston fluidly isolates the first chambers relative to one another, and wherein the second piston fluidly isolates the second chambers relative to one another;

a first flowline fluidly coupled to each of the first chambers;

a second flowline fluidly coupled to each of the second chambers;

a metering valve fluidly coupled between two of the plurality of chambers, wherein the metering valve is configured to incrementally choke flow therethrough between fully open and fully closed; and a fluid hydraulics block fluidly coupled between the sampling probe and the first and second flowlines.

2. The apparatus of claim 1 wherein the metering valve is a first metering valve coupled between the first chambers, and wherein the downhole tool further comprises a second metering valve fluidly coupled between the second chambers and configured to incrementally choke flow therethrough between fully open and fully closed.

3. The apparatus of claim 2 wherein the first metering valve is configured to vary a fluid pumping rate in the first flowline by varying a first differential pressure developed across the first chambers, and wherein the second metering valve is configured to vary a fluid pumping rate in the second flowline by varying a second differential pressure developed across the second chambers.

4. The apparatus of claim 2 further comprising a displacement unit control configured to control the first and second metering valves.

5. The apparatus of claim 4 wherein the downhole tool comprises the displacement unit control.

6. The apparatus of claim 4 wherein the displacement unit control is configured to control at least one of the first and second metering valves to adaptively vary a ratio of the fluid pumping rate in the first flowline to the fluid pumping rate in the second flowline.

7. The apparatus of claim 1 wherein the first and second chambers are all mechanically associated.

8. The apparatus of claim 7 wherein the first and second pistons are contained within a single body of the displacement unit assembly.

9. The apparatus of claim 1 wherein the first and second pistons are contained within a single body of the displacement unit assembly.

10. The apparatus of claim 1 wherein the displacement unit assembly includes first and second displacement units, wherein the first chambers are associated with the first displacement unit, and wherein the second chambers are associated with the second displacement unit.

11. The apparatus of claim 10 further comprising a motor configured to synchronously operate the first and second displacement units.

12. The apparatus of claim 11 further comprising a gearbox coupling the motor to the first and second displacement units.

13. The apparatus of claim 1 wherein the first flowline is one of a guard flowline and a sample flowline and the second flowline is the other of the guard flowline and the sample flowline.

14. An apparatus, comprising:

a downhole tool configured for conveyance within a wellbore extending into a subterranean formation, the downhole tool comprising:

a sampling probe configured to couple with a sidewall of the wellbore adjacent the formation and draw a fluid sample from the formation;

a displacement unit assembly comprising:

a first displacement unit comprising two first chambers separated by a first piston;

a second displacement unit comprising two second chambers separated by a second piston; and a shaft coupling the first and second pistons for synchronous movement upon movement of the shaft;

a motor configured to synchronously operate the first and second displacement units;

a first flowline fluidly coupled to each of the first chambers;

a second flowline fluidly coupled to each of the second chambers;

a first metering valve fluidly coupled between the first chambers and configured to incrementally choke flow therethrough between fully open and fully closed;

a second metering valve fluidly coupled between the second chambers and configured to incrementally choke flow therethrough between fully open and fully closed;

a displacement unit control configured to control the first and second metering valves, and further configured to control at least one of the first and second metering valves to adaptively vary a ratio of the fluid pumping rate in the first flowline to the fluid pumping rate in the second flowline; and a fluid hydraulics block fluidly coupled between the sampling probe and the first and second flowlines.

15. The apparatus of claim 14 wherein the first metering valve is configured to vary a fluid pumping rate in the first flowline by varying a first differential pressure developed across the first chambers, and wherein the second metering valve is configured to vary a fluid pumping rate in the second flowline by varying a second differential pressure developed across the second chambers.

16. The apparatus of claim 14 wherein the first and second chambers are all mechanically associated.

17. The apparatus of claim 16 wherein the first and second pistons are contained within a single body of the displacement unit assembly.

18. The apparatus of claim 14 wherein the first and second pistons are contained within a single body of the displacement unit assembly.

19. The apparatus of claim 14 further comprising a gearbox coupling the motor to the first and second displacement units.

20. The apparatus of claim 14 wherein the first flowline is one of a guard flowline and a sample flowline and the second flowline is the other of the guard flowline and the sample flowline.

* * * * *